US010780700B2

(12) United States Patent
Osakabe

(10) Patent No.: US 10,780,700 B2
(45) Date of Patent: Sep. 22, 2020

(54) PRINTING UNIT, PRINTING DEVICE, AND CAPPING DEVICE

(71) Applicant: CASIO COMPUTER CO., LTD., Shibuya-ku, Tokyo (JP)

(72) Inventor: Fumihiro Osakabe, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/358,448

(22) Filed: Mar. 19, 2019

(65) Prior Publication Data

US 2019/0291441 A1 Sep. 26, 2019

(30) Foreign Application Priority Data

Mar. 23, 2018 (JP) ..... 2018-056106

(51) Int. Cl.
*B41J 2/165* (2006.01)

(52) U.S. Cl.
CPC ..... *B41J 2/16505* (2013.01)

(58) Field of Classification Search
CPC . B41J 2/16505; B41J 2/16511; B41J 2/16508
See application file for complete search history.

(56) References Cited

U.S. PATENT DOCUMENTS

2014/0063119 A1* 3/2014 Dumas ..... B41J 2/16532 347/30
2017/0217185 A1* 8/2017 Wagner ..... B41J 2/155

FOREIGN PATENT DOCUMENTS

JP 2001225512 A 8/2001

* cited by examiner

*Primary Examiner* — Sharon A. Polk
(74) *Attorney, Agent, or Firm* — Holtz, Holtz & Volek PC

(57) ABSTRACT

A printing unit includes a printing device including a metal component, and a print head that prints a print-target image onto a print medium; and a capping device including a cap covering the print head, an elastic member that urges the cap toward the print head, and a magnet that attracts the metal component.

10 Claims, 8 Drawing Sheets

PRINTING UNIT, PRINTING DEVICE, AND CAPPING DEVICE

CROSS-REFERENCE TO RELATED APPLICATION

This application is based upon and claims the benefit of priority from the prior Japanese Patent Application No. 2018-56106, filed Mar. 23, 2018, the entire contents of which are incorporated herein by reference.

FIELD

This application relates generally to a printing unit, a printing device, and a capping device.

BACKGROUND

Unexamined Japanese Patent Application kokai Publication No. 2001-225512 describes a handy printer in which a recording head prints images onto recording paper while a printer main body is manually moved over the recording paper.

SUMMARY

A printing unit according to an aspect of the present disclosure includes:

a printing device that includes a metal component, and a print head that prints a print-target image onto a print medium; and a capping device that includes a cap covering the print head, an elastic member that urges the cap toward the print head, and a magnet that attracts the metal component.

A printing device according to an aspect of the present disclosure includes:

a print head that prints a print-target image onto a print medium, the print head being covered by a cap that is energized by an elastic member; and a metal component that is attracted by a magnet; wherein the print head is covered by the cap when the printing device is mounted on a capping device including the elastic member, the cap, and the magnet.

A capping device according to an aspect of the present disclosure includes:

a cap that covers a print head that prints a print-target image onto a print medium;

an elastic member that urges the cap toward the print head; and a magnet that attracts a metal component; wherein the print head is covered by the cap when a printing device including the print head and the metal component is mounted on the capping device.

BRIEF DESCRIPTION OF THE DRAWINGS

A more complete understanding of this application can be obtained when the following detailed description is considered in conjunction with the following drawings, in which.

DETAILED DESCRIPTION

Embodiment 1

Figure 1:
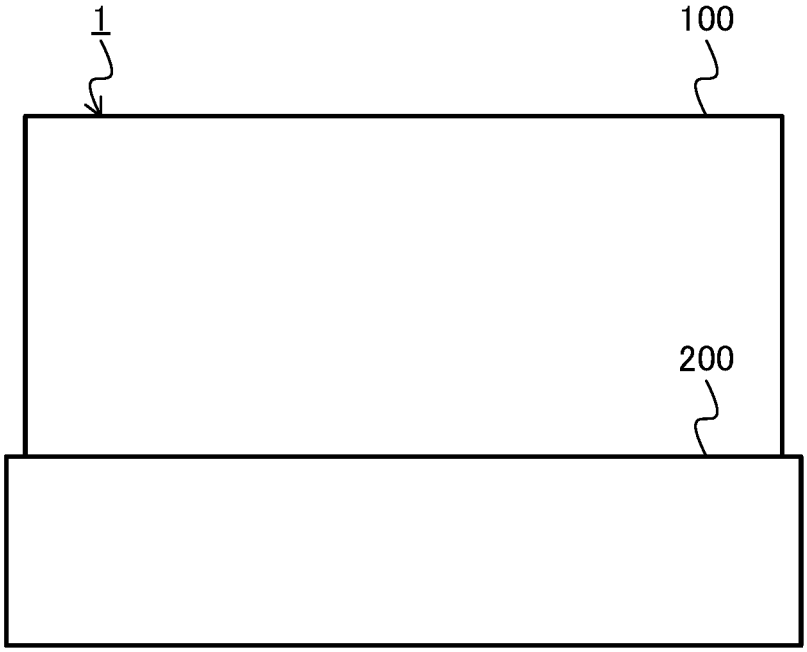
FIG. 1 is a side view of a printing unit according to Embodiment 1.

Hereinafter, a printing unit 1 according to Embodiment 1 is described while referencing the drawings. Note that, in the drawings, identical or corresponding components are marked with the same reference numerals.

FIG. 1 is a side view of the printing unit 1 according to Embodiment 1. As illustrated in FIG. 1, the printing unit 1 includes a printing device 100 and a capping device 200.

When not printing, the printing device 100 is mounted on the capping device 200. When printing is to be performed, the user removes the printing device 100 from the capping device 200, and holds and moves the printing device 100 over a print medium 2 in a sliding manner to print a print-target image onto the print medium 2. This type of manual sweeping-type printing device is also referred to as a handy printer, a hand-held printer, and a direct printer.

The capping device 200 is a stand on which the printing device 100 is mounted. The capping device 200 prevents a print head 120 (described later) from drying while the printing device 100 is mounted thereon.

The print medium 2 is a medium onto which the printing device 100 prints the print-target image. The print medium 2 is also referred to as recording media and a print object. The print medium 2 includes printing paper, printing labels, and cardboard and, typically, is made from paper and resin, but is not limited thereto. The print medium 2 may be formed from any material as long as the material has a surface condition that allows ink to adhere.

The print-target image is printed onto the print medium 2 by the printing device 100. The print-target image is also referred to as a print image or a printing pattern. The print-target image can include characters, shapes, patterns, pictures, and photographs, but is not limited thereto.

Figure 2A:
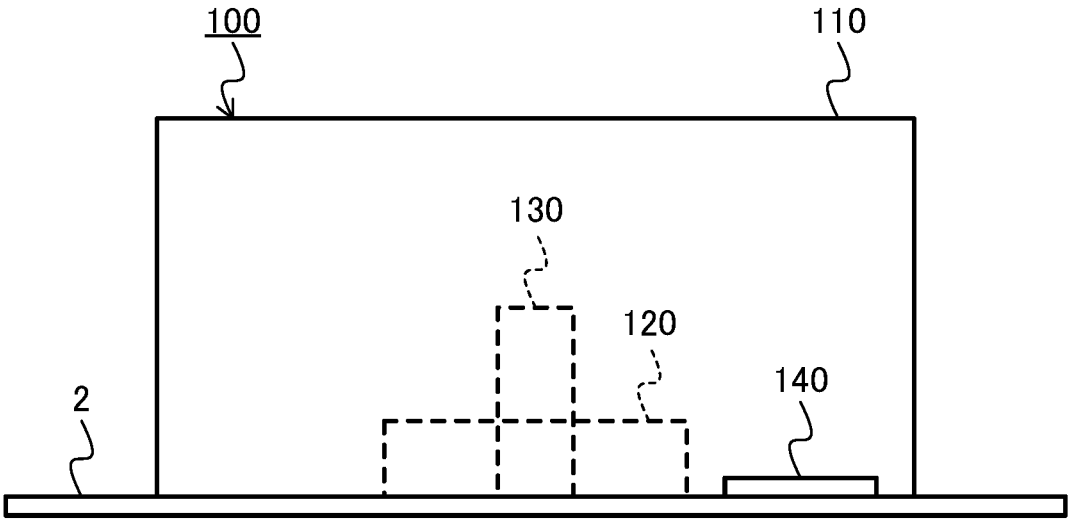
FIG. 2A is a side view of a printing device according to Embodiment 1.
Figure 2B:
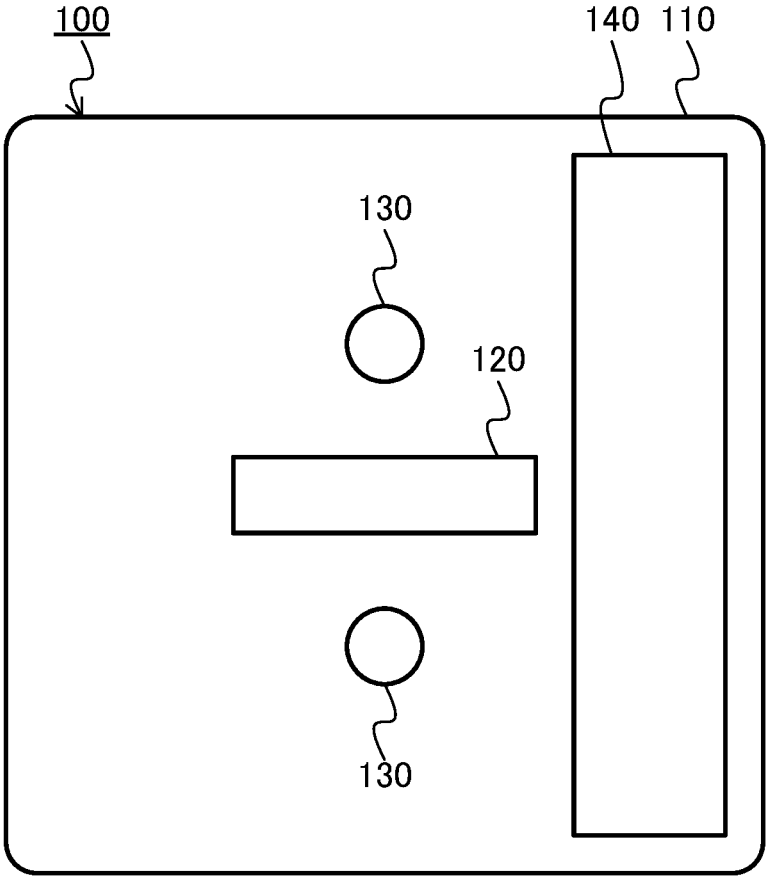
FIG. 2B is a bottom view of the printing device according to Embodiment 1.

FIG. 2A is a side view of the printing device 100, and FIG. 2B is a bottom view of the printing device 100. As illustrated in FIGS. 2A and 2B, the printing device 100 includes a housing 110, a print head 120, a sensor 130, and a metal component 140.

The housing 110 houses the print head 120 and the sensor 130, which are constituents of the printing device 100. As illustrated in FIG. 2B, the print head 120 and the sensor 130 are exposed from a surface, namely the bottom surface, of the housing 110 that contacts the print medium 2, and the metal component 140 is attached to the bottom surface. The housing 110 is typically formed from resin, but is not limited thereto. The housing 110 includes, in the interior, boards, processing devices, batteries, and the like, but these constituents are not illustrated in the drawings.

The print head 120 is disposed on the bottom surface of the housing 110 and prints the print-target image onto the print medium 2. A plurality of nozzles are arranged on the print head 120 in the main-scanning direction and the sub-scanning direction. The print head 120 prints using an ink jet printing method. In this method, ink stored in an ink tank is heated in the nozzles by a heater to produce air bubbles, and the ink is micronized by the produced air bubbles and discharged from each of the nozzles onto the print medium 2.

The sensor 130 is disposed on the bottom surface of the housing 110, and measures the amount that the printing device 100 moves relative to the print medium 2. As illustrated in FIG. 2B, the printing device 100 includes two sensors 130. The sensors 130 include a light emitting diode (LED) and an image sensor. The image sensor reads the light emitted from the LED and reflected from the print medium 2 and compares the reflected light from before and after movement to measure the amount and direction of movement of the printing device 100.

The metal component 140 is a rectangular metal plate disposed on the bottom surface of the housing 110. The metal component 140 includes a metal or an alloy that contains ferromagnetic material. When the printing device 100 is mounted on the capping device 200, the metal component 140 and magnets 220 (described later) of the capping device 200 are attracted to each other by the magnetic field generated by the magnets 220. Typically, the metal component 140 is implemented as an iron plate, but is not limited thereto and, provided that it is a material that is attracted to the magnets 220, may have irregularities on the surface.

The printing device 100 calculates the position of the print head 120 on the basis of the amount of movement, measured by the sensors 130, relative to the print medium 2, and prints a portion of the print-target image that corresponds to the calculated position using the print head 120. The printing device 100 executes the measuring of the amount of movement and the printing while being held and moved over the print medium 2 by the user. Thus, the entire print-target image is printed onto the print medium 2.

Figure 3A:
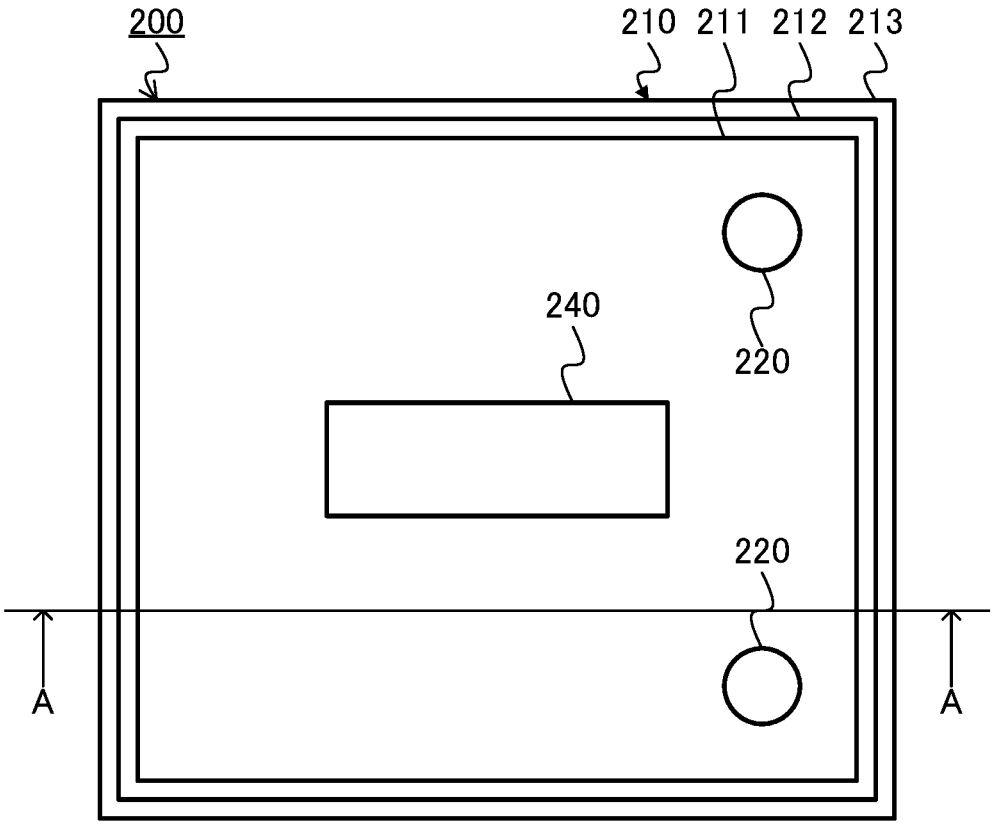
FIG. 3A is a top view of a capping device according to Embodiment 1.
Figure 3B:
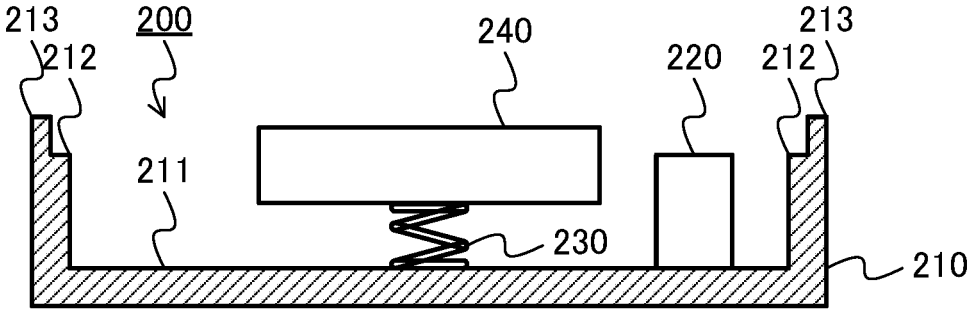
FIG. 3B is a cross-sectional view of the capping device according to Embodiment 1.

FIG. 3A is a top view illustrating the configuration of the capping device 200. FIG. 3B is a cross-sectional view taken along line AA of FIG. 3A. As illustrated in FIGS. 3A and 3B, the capping device 200 includes a capping device housing 210, magnets 220, an elastic member 230, and a cap 240.

The capping device housing 210 includes constituents of the capping device 200, namely, a bottom 211 on which the magnets 220, the elastic member 230, and the cap 240 are disposed, an inner periphery 212 erected around the bottom 211, and an outer periphery 213 erected outward from the inner periphery 212. The capping device housing 210 is typically formed from material similar to that of the housing 110 of the printing device 100, namely resin, but is not limited thereto.

The magnets 220 are disposed on the bottom 211. The magnets 220 project from the bottom 211. A first end of the elastic member 230 is connected to the bottom 211. The elastic member 230 is disposed so as to project from the bottom 211.

The inner periphery 212 is erected around the bottom 211. An end of the inner periphery 212 contacts the bottom surface of the printing device 100 when the printing device 100 is mounted on the capping device 200.

The outer periphery 213 is erected integrally with the inner periphery 212, outward from the inner periphery 212, which is erected around the bottom 211. The outer periphery 213 projects from the bottom 211 beyond the edge of the inner periphery 212. The inner edge of the outer periphery 213 that does not contact the inner periphery 212 instead contacts the periphery of the printing device 100 when the printing device 100 is mounted on the capping device 200.

The magnets 220 attract the metal component 140 of the printing device 100. As a result of the magnets 220 attracting the metal component 140, the printing device 100 is guided so that the print head 120 is appropriately covered by the cap 240 when the printing device 100 is mounted on the capping device 200. Due to the magnets 220 attracting the metal component 140, the state in which the print head 120 is appropriately covered by the cap 240 is maintained and the printing device 100 is prevented from sliding off the capping device 200 while the printing device 100 is mounted on the capping device 200.

A first end of the elastic member 230 is connected to the bottom 211, and a second end is connected to the cap 240. The elastic member elastically energizes the cap 240. The elastic member 230 is typically a coil formed from metal, but the material and shape of the elastic member 230 is not limited thereto.

Figure 4:
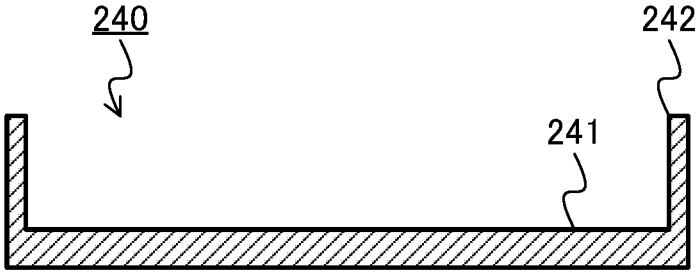
FIG. 4 is a cross-sectional view of a cap according to Embodiment 1.

The cap 240 covers the print head 120 while the printing device 100 is mounted on the capping device 200. The cap 240 is typically formed from rubber, but is not limited thereto. The cap 240 covering the print head 120 prevents clogging of the nozzles caused by the ink drying, adhering of foreign matter including debris and dust to the print head 120, damaging of the nozzles due to the print head 120 coming in contact with the capping device housing 210, and declines in printing quality caused by these problems. The cap 240 functions as a covering means FIG. 4 is a cross-sectional view illustrating the configuration of the cap 240. As illustrated in FIG. 4, the cap 240 includes a cap bottom 241 that connects to the elastic member 230 on a first surface, and a cap periphery 242 erected in the direction opposite the first surface to which the elastic member 230 connects. The cap periphery 242 is erected on the fringe of the cap bottom 241. The cap 240 covers the print head 120 as a result of the cap periphery 242 contacting the bottom surface of the printing device 100. The cap bottom 241 has a shape that matches the shape of the lower surface of the print head 120. While the shape of the cap bottom 241 is rectangular in the drawings, any shape may be used, provided that the shape of the cap bottom 241 matches the shape of the lower surface of the print head 120.

Figure 5:
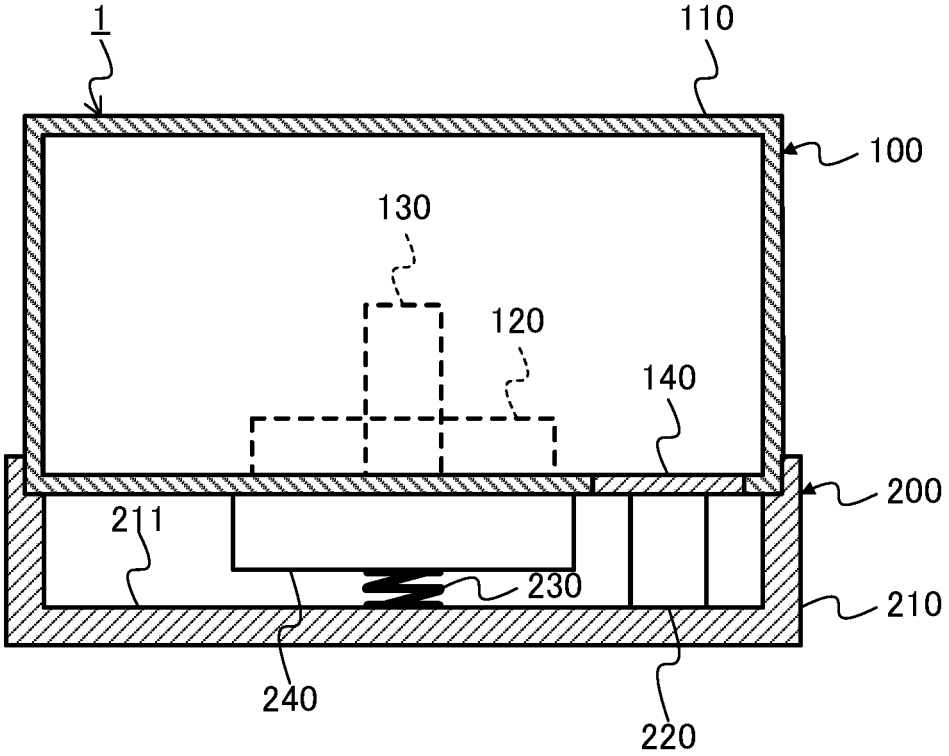
FIG. 5 is a cross-sectional view illustrating a state in which the printing device of Embodiment 1 is mounted on the capping device.

FIG. 5 is a cross-sectional view illustrating a state in which the printing device 100 is mounted on the capping device 200. As illustrated in FIG. 5, the bottom of the printing device 100 contacts the end of the inner periphery 212 of the capping device 200, and the periphery of the printing device 100 contacts the inner edge of the outer periphery 213 of the capping device 200.

The magnets 220 attract the metal component 140 of the printing device 100, thereby fixing the printing device 100 to the capping device 200.

The cap 240 is energized by the elastic member 230 and brought into contact with the bottom surface of the printing device 100, thereby covering the print head 120.

Due to the configuration described above, with the printing unit according to Embodiment 1, the print head 120 is covered due to the user mounting the printing device 100 on the capping device 200. As a result, the work of covering the print head 120 with the cap 240 can be simplified.

The cap 240 is connected to the capping device housing 210 via the elastic member 230 and, as such, the cap 240 moves flexibly and can appropriately cover the print head 120, regardless of the direction and angle at which the user mounts the printing device 100 on the capping device 200.

Since the printing device 100 and the capping device 200 are attracted to each other due to the metal component 140 and the magnet 220, the printing device 100 can be guided to the appropriate position when the user mounts the printing device 100 on the capping device 200. As a result, the mounting work can be simplified. Moreover, the mounted printing device 100 can be prevented from sliding off the capping device 200.

In cases in which the self-weight of the printing device is used as the force that maintains the state of the cap covering the print head, the weight of the printing device may change according to the remaining amount of ink or whether batteries are installed. In such cases, it may become impossible to appropriately maintain the covering. The printing unit 1 according to Embodiment 1 uses the repulsive force of the elastic member 230 and the attractive force of the magnets 220 to enable the maintenance of appropriate covering, regardless of the weight of the printing device 100.

Embodiment 2

Hereinafter, a printing unit 1 according to Embodiment 2 is described while referencing the drawings. The configuration of the capping device 200 according to Embodiment 2 is the same as the capping device 200 according to Embodiment 1.

Figure 6:
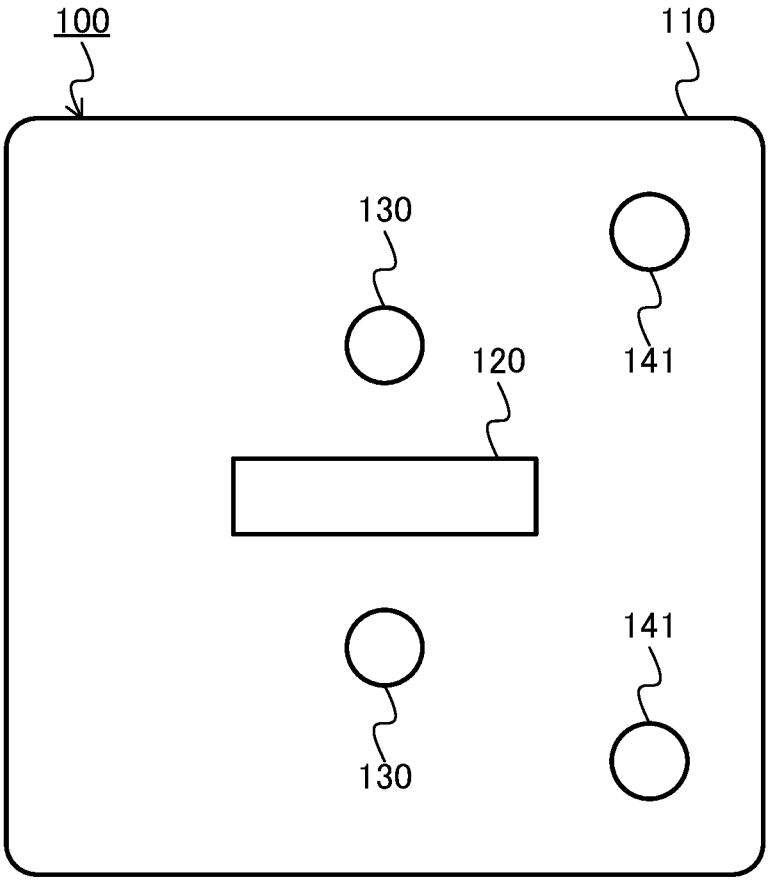
FIG. 6 is a bottom view of a printing device according to Embodiment 2.

FIG. 6 is a bottom view of the printing device 100 according to Embodiment 2. As illustrated in FIG. 6, the printing device 100 according to Embodiment 2 includes a plurality of metal components 141 in place of the metal component 140 of the printing device 100 according to Embodiment 1.

The metal components 141 are circular metal plates disposed on the bottom surface of the housing 110. The metal components 141 attach to the magnets 220 of the capping device 200 when the printing device 100 is mounted on the capping device 200. The metal components 141 are formed from material similar to that of the metal component 140.

The metal components 141 and the magnets 220 are of similar shape and size. The metal components 141 are disposed so as to overlap with the magnets 220 when the printing device 100 is mounted on the capping device 200.

Due to the configuration described above, with the printing unit 1 according to Embodiment 2, in addition to the advantageous effects demonstrated by the printing unit 1 according to Embodiment 1, it is easier for a user to perform alignment when mounting the printing device 100 on the capping device 200 due to the overlapping metal components 141 and the magnets 220 being attracted to each other.

Embodiment 3

Hereinafter, a printing unit 1 according to Embodiment 3 is described while referencing the drawings. The configuration of the capping device 200 of Embodiment 3 is similar to that of the capping device 200 of Embodiment 1.

Figure 7:
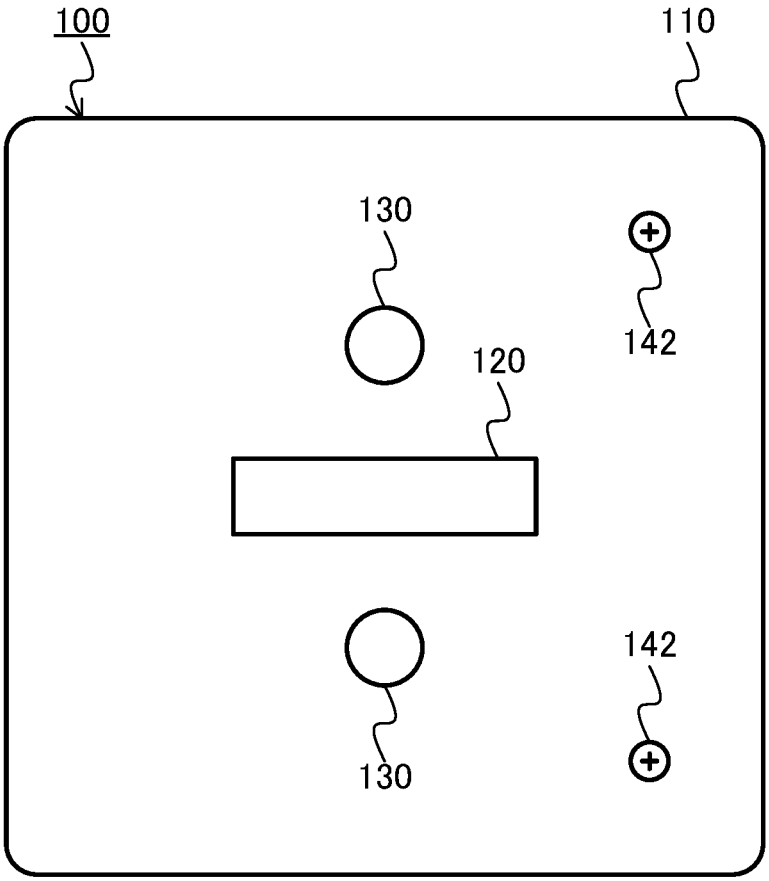
FIG. 7 is a bottom view of a printing device according to Embodiment 3.

FIG. 7 is a bottom view of the printing device 100 according to Embodiment 3. As illustrated in FIG. 7, the printing device 100 according to Embodiment 3 includes a plurality of fixing members 142 in place of the metal component 140 of the printing device 100 according to Embodiment 1.

The fixing members 142 are metal fixing members and are disposed on the bottom surface of the housing 110. The fixing members 142 are used to fix the bottom surface of the housing 110 to another surface, internal boards, and the like. The fixing members 142 are typically screws, but are not limited thereto. The fixing members 142 are formed from material similar to that of the metal component 140. The fixing members 142 attach to the magnets 220 of the capping device 200 when the printing device 100 is mounted on the capping device 200.

The fixing members 142 are disposed so as to overlap with the magnets 220 when the printing device 100 is mounted on the capping device 200.

Due to the configuration described above, with the printing unit 1 according to Embodiment 3, in addition to the advantageous effects demonstrated by the printing units 1 according to Embodiments 1 and 2, the fixing members 142 used to fix the constituents of the housing 110 also function as metal components that are attracted to the magnets 220. Therefore, the number of components of the printing device 100 can be reduced.

Embodiment 4

Hereinafter, a printing unit 1 according to Embodiment 4 is described while referencing the drawings. The configuration of the capping device 200 according to Embodiment 4 is the same as the capping device 200 according to Embodiment 1.

Figure 8:
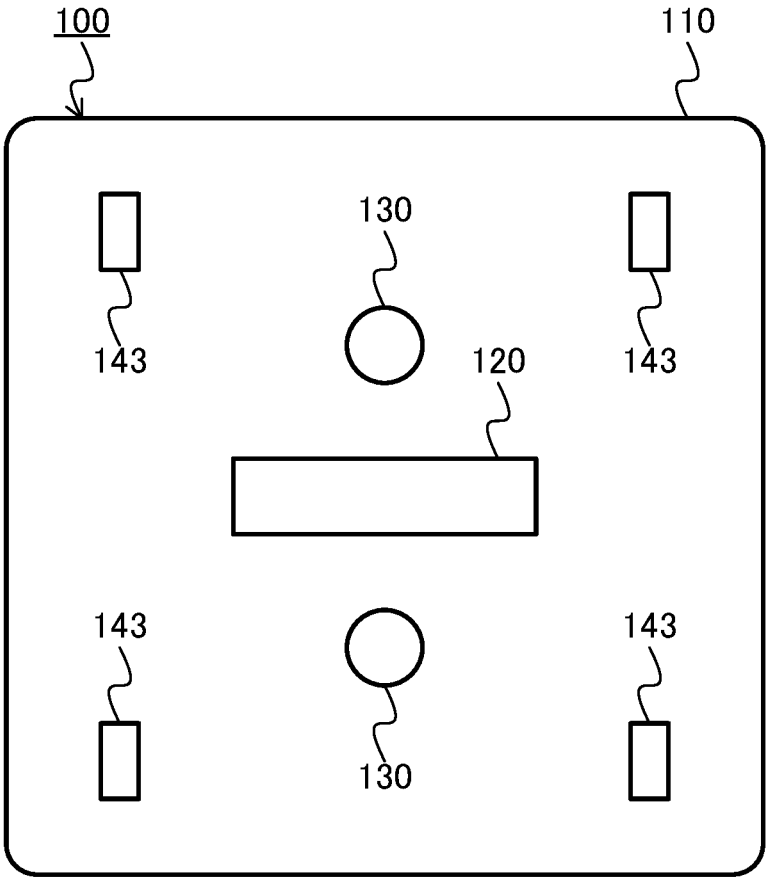
FIG. 8 is a bottom view of a printing device according to Embodiment 4.

FIG. 8 is a bottom view of a printing device 100 according to Embodiment 4. As illustrated in FIG. 8, the printing device 100 according to Embodiment 4 includes a plurality of rollers 143 in place of the metal component 140 of the printing device 100 according to Embodiment 1.

The rollers 143 are disposed rotatably on the bottom surface of the housing 110. The rollers 143 assist the sliding of the printing device 100 over the print medium 2. The rollers 143 are formed from material similar to that of the metal component 140. The rollers 142 attach to the magnets 220 of the capping device 200 when the printing device 100 is mounted on the capping device 200.

At least a portion of the rollers 143 is disposed so as to overlap with the magnets 220 when the printing device 100 is mounted on the capping device 200. In this case, the magnets 220 may be the same as the magnets 220 of Embodiment 1, or a number of magnets 220 corresponding to the number of rollers 143 may be disposed at positions opposite the rollers 143.

Due to the configuration described above, with the printing unit 1 according to Embodiment 4, in addition to the advantageous effects demonstrated by the printing units 1 according to Embodiments 1 and 2, the rollers 143 used to assist the sliding of the printing device 100 also function as metal components that are attracted to the magnets 220. Therefore, the need to provide dedicated magnets that are attracted to the magnets 220 separate from the rollers 143 is eliminated.

Embodiment 5

Hereinafter, a printing unit 1 according to Embodiment 5 is described while referencing the drawings. The configuration of the capping device 200 of Embodiment 5 is the same as the capping device 200 of Embodiment 1.

Figure 9:
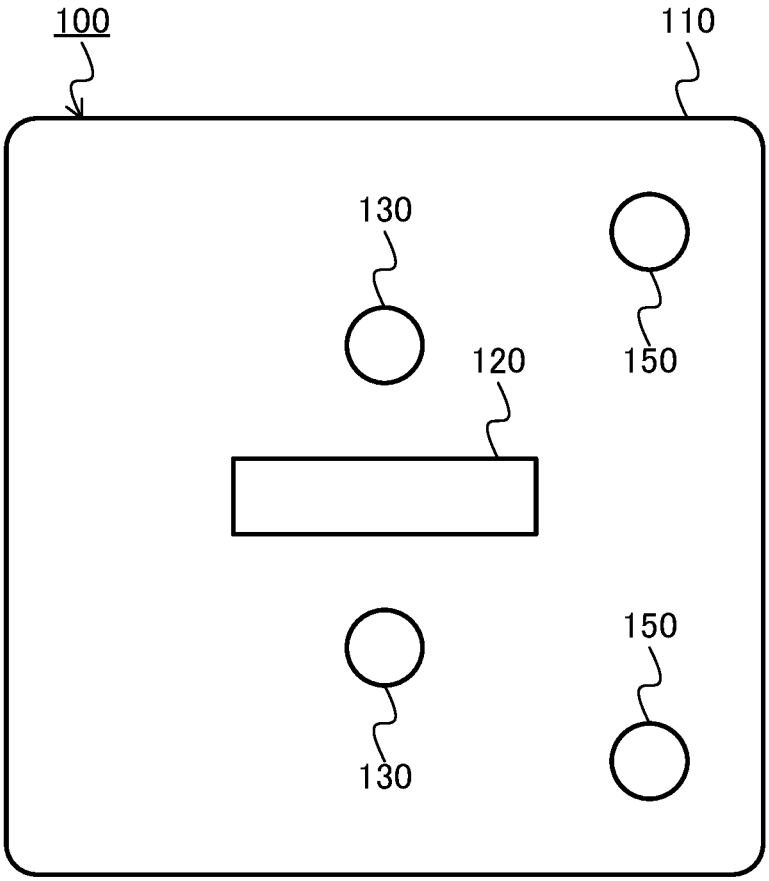
FIG. 9 is a bottom view of a printing device according to Embodiment 5.

FIG. 9 is a bottom view of the printing device 100 according to Embodiment 5. As illustrated in FIG. 9, the printing device 100 according to Embodiment 5 includes a plurality of magnets 150 in place of the metal component 140 of the printing device 100 according to Embodiment 1.

The magnets 150 are circular magnets disposed on the bottom surface of the housing 110. The magnets 150 and the magnets 220 are configured such that the poles on the sides of the magnets 150 facing the magnets 220 are one of a S pole and a N pole, and the poles on the sides of the magnets 220 facing the magnets 150 are the other of the S pole and the N pole. The magnets 150 of the printing device 100 attach to the magnets 220 of the capping device 200 when the printing device 100 is mounted on the capping device 200.

The magnets 150 and the magnets 220 are of similar same shape and size. The magnets 150 are disposed so as to overlap with the magnets 220 when the printing device 100 is mounted on the capping device 200. The polarities of the magnets 150 and the magnets 220 are arranged such that the magnets 150 and the magnets 220 are attracted to each other when the printing device 100 is mounted on the capping device 200.

Due to the configuration described above, with the printing unit 1 according to Embodiment 5, in addition to the advantageous effects demonstrated by the printing unit 1 according to Embodiments 1 and 2, the attractive force between the printing unit 100 and the capping device 200 is strengthened and, as a result, it is easier for a user to perform alignment when mounting the printing device 100 on the capping device 200 and the printing device 100 can be reliably prevented from sliding off the capping device 200.

Modified Examples

Embodiments of the present disclosure are described above, but these embodiments are merely examples and do not limit the scope of application of the present disclosure. That is, various applications of the embodiments of the present disclosure are possible, and all embodiments are included in the scope of the present disclosure.

In the embodiments described above, examples are given in which the sensors 130 include an LED and an image sensor, and the image sensor reads the light emitted from the LED and reflected from the print medium 2 to measure the amount of movement. However, the sensors 130 are not limited thereto. A configuration is possible in which the sensors 130 include rollers or balls disposed on the bottom surface of the housing 110 and measure the amount of movement by measuring the rotation of the rollers or balls. Moreover, a configuration is possible in which the sensors 130 include laser light sources, and the image sensors read the laser light emitted from the laser light source and reflected from the print medium 2 to measure the amount of movement.

In the embodiments described above, examples are given in which the printing device 100 includes two sensors 130. However, the number of sensors 130 is not limited thereto. Configurations are possible in which the printing device 100 includes one sensor 130 or three or more sensors 130.

In the embodiments described above, examples are given in which the metal components 140 and 141, the fixing members 142, the rollers 143, and the magnets 150 are disposed on the bottom surface of the printing device 100. However, the location at which these constituents are disposed is not limited thereto. Configurations are possible in which the metal components 140 and 141, the fixing members 142, the rollers 143, and the magnets 150 are disposed at a desired location other than on the bottom surface of the printing device 100. In such cases, the magnets 220 of the capping device 200 are disposed at positions that overlap with the metal components 140 and 141, the fixing members 142, the rollers 143, or the magnets 150 when the printing device 100 is mounted on the capping device 200.

The configurations described in Embodiments 1 to 5 may be combined. For example, a configuration is possible in which the printing device 100 includes the metal component 140 of Embodiment 1 and the fixing members 142 of Embodiment 3.

In this specification, the term "metal component" is used to indicate that the component is attracted to magnets and should be construed as including non-metal objects as well.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing unit, comprising:

a printing device that includes a metal component, and a print head that is configured to print a print-target image onto a print medium; and a capping device configured to have the printing device mounted thereon, the capping device including a cap configured to cover the print head, an elastic member configured to urge the cap toward the print head, and a magnet that attracts the metal component;

wherein:

the metal component comprises a fixing member that is fixed to the printing device, and the fixing member is positioned to overlap with the magnet when the printing device is mounted on the capping device.

2. The printing unit according to claim 1, wherein:

the metal component further comprises a metal plate, and the metal plate is positioned to overlap with the magnet when the printing device is mounted on the capping device.

3. The printing unit according to claim 1, wherein:

the metal component further comprises a roller that is rotatable to assist sliding of the printing device with respect to the print medium, and the roller is positioned to overlap with the magnet when the printing device is mounted on the capping device.

4. The printing unit according to claim 1, wherein the capping device further includes a housing which comprises a bottom, an inner periphery erected around the bottom, and an outer periphery erected outward from the inner periphery, wherein the outer periphery projects from the bottom beyond the inner periphery.

5. The printing unit according to claim 4, wherein an inner edge of the outer periphery of the housing is configured to contact the printing device when the printing device is mounted on the capping device.

6. A printing device, comprising:

a print head that is configured to print a print-target image onto a print medium, the print head being configured to be covered by a cap that is supported by an elastic member; and a metal component that is attracted by a magnet;

wherein:

the print head is covered by the cap when the printing device is mounted on a capping device including the elastic member, the cap, and the magnet, the metal component includes a fixing member that is fixed to the printing device, and the fixing member is positioned to overlap with the magnet when the printing device is mounted on the capping device.

7. A capping device, comprising:

a cap configured to cover a print head that prints a print-target image onto a print medium;

an elastic member that urges the cap toward the print head; and a magnet that attracts a metal component;

wherein:

the print head is covered by the cap when a printing device including the print head and the metal component is mounted on the capping device, the metal component includes a fixing member that is fixed to the printing device, and the fixing member is positioned to overlap with the magnet when the printing device is mounted on the capping device.

8. The capping device according to claim 7, further comprising:

a housing which comprises a bottom, an inner periphery erected around the bottom, and an outer periphery erected outward from the inner periphery, wherein the outer periphery projects from the bottom beyond the inner periphery.

9. The capping device according to claim 8, wherein an inner edge of the outer periphery of the housing is configured to contact the printing device when the printing device is mounted on the capping device.

10. A printing unit, comprising:

a printing device that includes a metal component, and a print head that is configured to print a print-target image onto a print medium; and a capping device configured to have the printing device mounted thereon, the capping device including a cap configured to cover the print head, an elastic member configured to urge the cap toward the print head, and a magnet that attracts the metal component;

wherein:

the metal component includes a roller that rotates to assist sliding of the printing device with respect to the print medium, and the roller is positioned to overlap with the magnet when the printing device is mounted on the capping device.

* * * * *